US007803073B2

(12) United States Patent
Sullivan

(10) Patent No.: US 7,803,073 B2
(45) Date of Patent: Sep. 28, 2010

(54) COMPACT BROADHEAD

(76) Inventor: Kevin Michael Sullivan, 633 Ramey Rd., Lakemont, GA (US) 30552

( * ) Notice: Subject to any disclaimer, the term of this patent is extended or adjusted under 35 U.S.C. 154(b) by 494 days.

(21) Appl. No.: 11/956,029

(22) Filed: Dec. 13, 2007

(65) Prior Publication Data

US 2009/0156335 A1 Jun. 18, 2009

(51) Int. Cl.
*F42B 6/08* (2006.01)

(52) U.S. Cl. ..... 473/584; 473/583

(58) Field of Classification Search ..... 473/583, 473/584

See application file for complete search history.

(56) References Cited

U.S. PATENT DOCUMENTS 2,940,758 A * 6/1960 Richter ..... 473/584
4,210,330 A * 7/1980 Kosbab ..... 473/584
5,145,186 A * 9/1992 Maleski ..... 473/584
5,482,294 A 1/1996 Sullivan et al.
6,319,161 B1 * 11/2001 Martinez et al. ..... 473/583
6,540,628 B1 * 4/2003 Musacchia, Jr. ..... 473/583
2009/0124439 A1 * 5/2009 Sullivan ..... 473/584

* cited by examiner

*Primary Examiner*—John Ricci
(74) *Attorney, Agent, or Firm*—Akerman Senterfitt; Michael K. Dixon

(57) ABSTRACT

An axially compact broadhead for archery and other such purposes is disclosed. The broadhead may be formed from a tip configured to facilitate penetration of the tip into an object with a pointed distal end and an opposite proximal end. The tip may include a central tip chamber extending distally into the tip from the proximal end and a plurality of blade slots extending from the proximal end of the tip toward the distal end. A base may be positioned proximally of the tip and have a central base chamber. One or more blades may be positioned in the blade slots and extend outwardly from the tip. An elongated engaging bar may extend through the central base chamber of the base and into the central tip chamber to affix the blades and provide a post for attaching the broadhead to an insert of an arrow.

20 Claims, 6 Drawing Sheets

COMPACT BROADHEAD

FIELD OF THE INVENTION

This invention is directed generally to broadheads, and more particularly to compact broadheads.

BACKGROUND

Modern broadheads are tips attachable to a distal end of an arrow shaft and include one or more blades having cutting arrises. The blades extend outwardly from a generally cylindrical broadhead body. The blades typically extend from the broadhead such that the cutting arris of each blade are at an acute angle relative to a longitudinal axis of the broadhead body and extend from a distal point at an intersection at an outer surface of the broadhead body to near the tip at an outer surface of the broadhead body to a proximal point radially outward of the outer surface of the broadhead body. In this position, the blades are capable of cutting flesh as the broadhead passes through an animal.

Modern compound bows can propel arrows at speeds of greater than 300 feet per second. Accurate arrow flight at such speeds is typically only accomplished when all components of the bow and arrow system are tuned properly. For instance, cam timing, cam and wheel alignment, rest position, arrow nock position, fletching clearance, arrow weight consistency, arrow spline consistency, broadhead configuration, and broadhead alignment are all factors that can each greatly affect accuracy. Broadheads have always proved challenging to tune. A longitudinal axis of a broadhead must be aligned with a longitudinal axis of the arrowshaft. Otherwise, the blades can act as airfoils and cause the arrows to plane, which severely affects accuracy.

Broadheads often need to be aligned relative to the arrowshaft to insure adequate clearance of the broadhead past the arrow shelf of a bow. In addition, the blades of a broadhead often need to be aligned with the fletching of an arrow and relative to the bow riser. In particular, in connection with broadheads having two bladed designs, it is often desirable to align the blades of the broadhead such that the blades are generally aligned with the riser of the bow. Sometimes, the blades may need to be aligned differently to create the most consistent arrow flight, which is often determined through repeated use.

Broadheads are commonly attached to arrows through use of a threaded insert glued into the end of a hollow aluminum or carbon arrow. Broadheads typically include a threaded post sized to be inserted into the insert and tightened down with a broadhead wrench. Once the broadhead is tightened into position, the alignment of the blades of the broadhead is examined. The alignment of the blades may be changed in aluminum arrows by heating the insert to loosen or melt the glue so that the insert may be rotated within the aluminum shaft. Carbon arrows may not be heated because the heat can easily damage the carbon fibers. While heating the arrows enables the inserts to be rotatable within the arrow shaft, repeated heating typically reduces the strength of the glues and often creates poor connections between the inserts and the arrows.

SUMMARY OF THE INVENTION

This invention relates to a compact broadhead attachable to an arrow shaft. The broadhead is constructed such that the broadhead is relatively compact in length in comparison to conventional broadheads. The broadhead may be formed from a tip configured to facilitate penetration of the tip into an object. The tip may include an open proximal end into which blades and an elongated engaging bar are inserted. The blades extend outwardly through slots in the tip and are held in place with the elongated engaging bar forcing a base against the tip. The blades may be aligned with cutting arrises on the tip, which enables the blades to be positioned closer to the distal end of the tip, thereby reducing the length of the broadhead. The broadhead may also include a tunable broadhead system enabling orientation of the blades of the broadhead to be changed relative to an arrow.

The broadhead may be formed from a tip configured to facilitate penetration of the tip into an object with a pointed distal end and an opposite, open proximal end. The tip may include a central tip chamber extending distally into the tip from the proximal end, a threaded distal tip chamber extending distally from a distal end of the central tip chamber, and a plurality of blade slots between an outer surface of the tip and the central tip chamber and extending from the proximal end of the tip toward the distal end. In one embodiment, the pointed tip may be formed from a trocar having a plurality of cutting arrises, wherein the cutting arrises may be aligned with the blade slots.

A base may be positioned proximally of the tip and have a central base chamber extending therethrough. The base may include base blade slots corresponding to the plurality of blade slots in the tip that receive the blades and prevent the blades from moving axially rearward. The base blade slots may be contained within a head section of the base, whereby the head section extends radially outwardly further than an aft section of the base. The base may also include a tapered recessed opening at the distal end of the base, and the tip may include a chamfered proximal end sized to mate with the tapered recessed opening of the base. When the base is pressed against the tip, the base compresses the tip by compressing the blade slots, reducing their size so that portions of the tip are compressed against the blades for additional support.

The broadhead may include at least one blade positioned in one of the blade slots and extending outwardly from the tip. A securing flange may extend from the at least one blade into the central chamber. The securing flange of the blade may extend through a securing flange region of the blade slot, and portions of the blade without the securing flange may extend into the base blade slots and into the distal blade slot region on the tip. The broadhead may also include an elongated engaging bar having a threaded proximal end and a threaded distal end. The elongated engaging bar may extend through the central base chamber of the base and into the central tip chamber where the threaded distal end threadably engages the threaded distal tip chamber. The elongated engaging bar may also include a bar stop extending radially a distance sufficient to contact a proximal end the base to force the base against the tip.

The broadhead may also include a tunable broadhead system enabling orientation of the blades of the broadhead to be changed relative to an arrow into which the threaded proximal end of the elongated engaging bar may be inserted. The tunable broadhead system may comprise a threadlocker material applied to the threaded distal end of the elongated engaging bar increasing the friction between the threads of the distal tip chamber and the threaded distal end of the elongated engaging bar such that a force required to rotate the elongated engaging bar is greater than a force necessary to rotate the threaded proximal end of the elongated engaging bar into an insert of an arrow. As such, the broadhead may be attached to an insert of an arrow without the elongated engaging bar rotating first. In another embodiment, the tunable broadhead system may include a releasable locking device configured to releasably affix the elongated engaging bar relative to the tip to prevent the elongated engaging bar from being rotated relative to the tip. In one embodiment, the releasable locking device may be a threaded set screw threadably attached to a threaded orifice in the tip or the base. The releasable locking device is not limited to this configuration, but may have other appropriate configurations as well.

An advantage of this invention is that the blades may be positioned closer to the distal end of the tip than conventional broadheads because the blade slots are aligned with the cutting arrises at the distal end of the tip, thereby creating a compact broadhead with replaceable blades.

Another advantage of this invention is that the blades may be oriented in any position independent of the orientation of the insert within an end of the arrow shaft. Thus, the blades may be oriented in any positioned about a longitudinal axis of the arrow shaft to improve clearance and accuracy. For instance, the blades of three blade embodiments may be aligned with the fletching on the arrow. In other embodiments, such as two blade embodiments, the blades may be aligned to reduce planing upon the broadhead leaving the bow during the initial moments of the shot.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
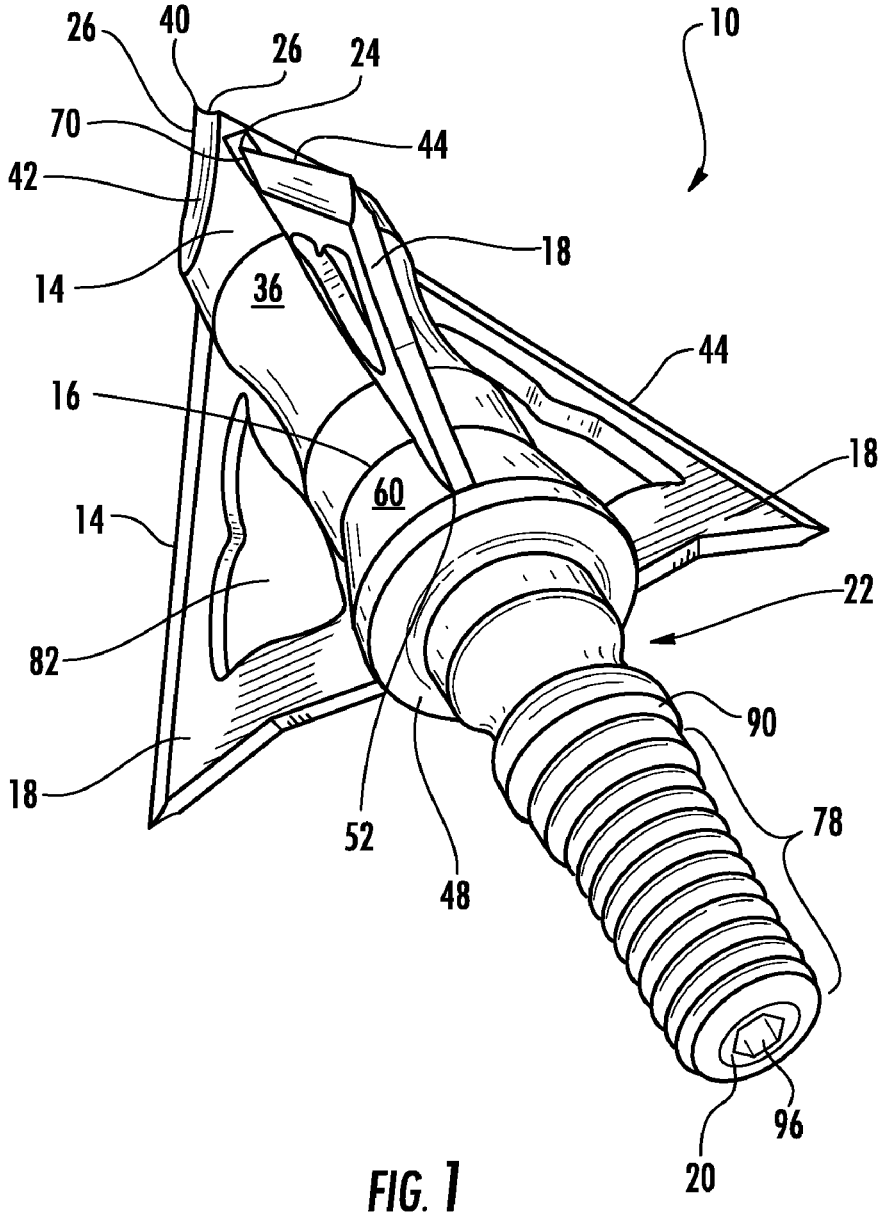
FIG. 1 is a perspective view of a broadhead of the invention.

As shown in FIGS. 1-8, this invention is directed to a compact broadhead 10 attachable to an arrow shaft 12. The broadhead 10 is constructed such that the broadhead 10 is relatively compact in length in comparison to conventional broadheads. The broadhead 10 may be formed from a tip 14 configured to facilitate penetration of the tip 14 into an object. The tip 14 may include an open proximal end 16 into which blades 18 and an elongated engaging bar 20 are inserted. The blades 18 extend outwardly through slots 24 in the tip 14 and are held in place with the elongated engaging bar forcing a base 22 against the tip 14. The blades 18 may be aligned with cutting arrises 26 on the tip 14, which enables the blades 18 to be positioned closer to the distal end 28 of the tip 14, reducing the length of the broadhead 10. The broadhead 10 may also include a tunable broadhead system 30 enabling orientation of the blades 18 of the broadhead 10 to be changed relative to an arrow 12.

Figure 5:
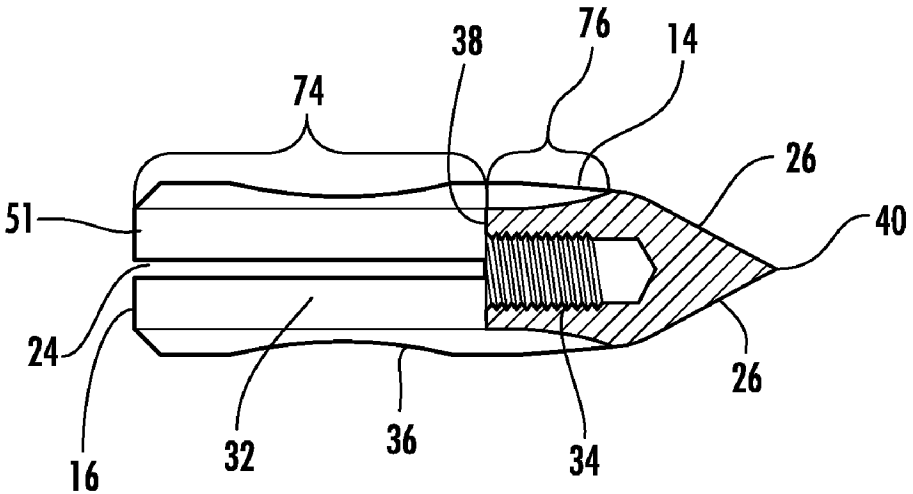
FIG. 5 is a cross-sectional view of the tip of the broadhead taken at section line 5-5 in FIG. 3.

The tip 14 may include a pointed distal end 28 and an opposite, open proximal end 16, wherein the distal end 28 may be configured to facilitate penetration of the tip 14 into an object. The tip 14 may include a central tip chamber 32 extending distally into the tip 14 from the proximal end 16, thereby forming an opening in the proximal end 16. The tip 14 may also include a threaded distal tip chamber 34 extending distally from a distal end 28 of the central tip chamber 32. As shown in FIG. 5, a plurality of blade slots 24 may extend radially between an outer surface 36 of the tip 14 and the central tip chamber 32 and may extend axially from the proximal end 16 of the tip 14 toward the distal end 28. In at least one embodiment, as shown in FIG. 5, the blade slots 24 may extend distally of the distal end 38 of the central tip chamber 32 and terminate proximally of the cutting arrises 26 of the tip 14. The blade slots 24 may have a width slightly larger than a thickness of the blades 18 to enable the blades 18 to protrude through the blade slots 24.

Figure 2:
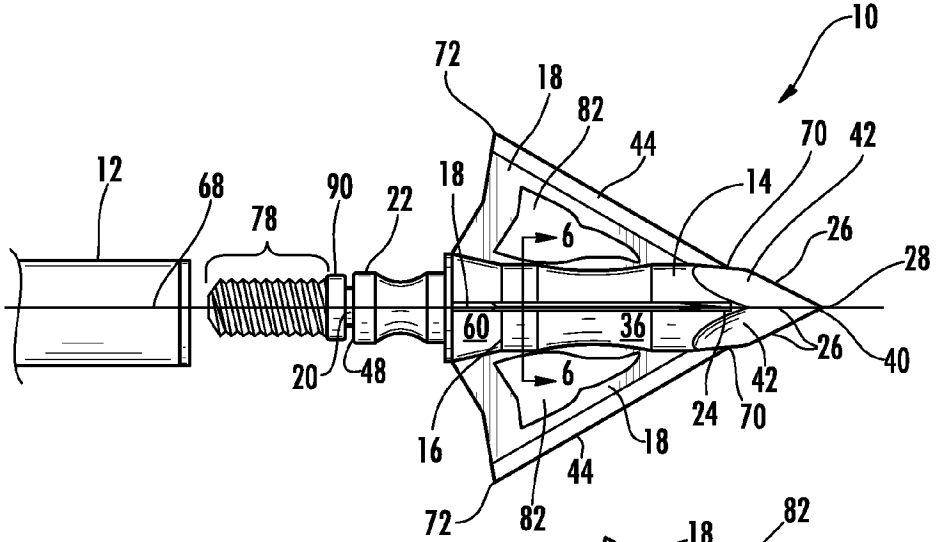
FIG. 2 is a side view of the broadhead of FIG. 1.
Figure 3:
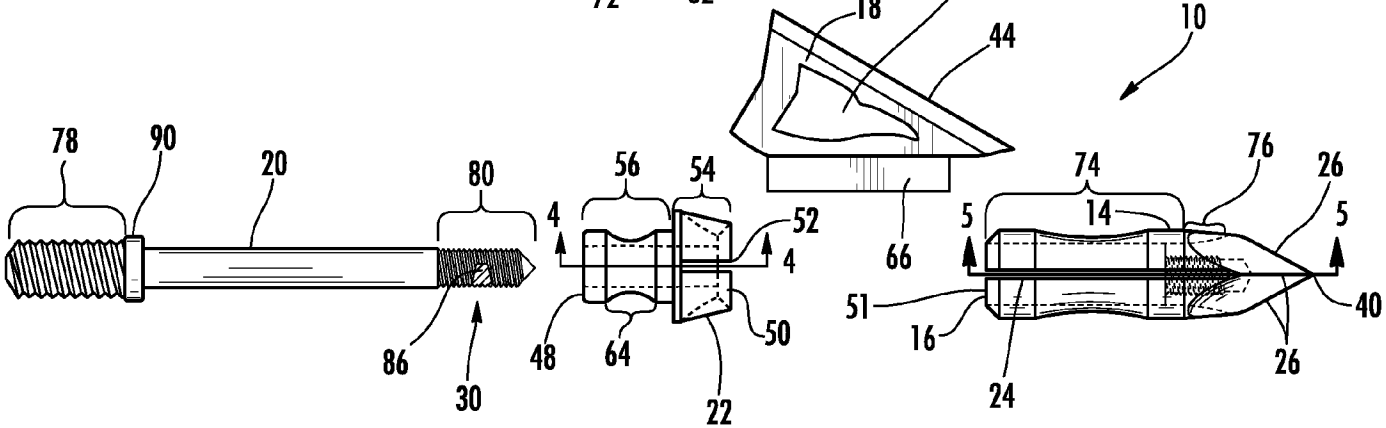
FIG. 3 is a partial exploded perspective view of the broadhead of FIG. 1.

The tip 14 may be pointed and include any appropriate configuration facilitating penetration of the tip 14 into a target, such as an animal or other target. In one embodiment, as shown in FIGS. 1-3, the tip 14 may include three cutting arrises 26 that extend from the point 40 and are separated by surfaces 42. The number of cutting arrises 26 may or may not correspond to the number of blades 18. In one embodiment, the pointed tip 14 may not have any cutting arrises. In other embodiment, the pointed tip 14 may have one or more cutting arrises 26. The blade slots 24 may be aligned with the cuffing arrises 26, thereby enabling the cutting arrises 26 of the tip 14 to be aligned with the cutting arrises 44 of the blades 18. The tip 14 may be generally cylindrical or have another appropriate shaped outer surface.

A base 22 may be positioned proximally of the tip 14 and may have a central base chamber 46 extending through the base 22 and forming openings at proximal and distal ends 48, 50. The central base chamber 46 may be sized to receive the elongated engaging bar 20. In one embodiment, the base 22 may include base blade slots 52 corresponding to the plurality of blade slots 24 in the tip 14 that receive the blades 18 and prevent the blades 18 from moving axially rearward. The base blade slots 52 may be contained within a head section 54 of the base 22, whereby the head section 54 extends radially outwardly further than an aft section 56 of the base 22. The head and aft sections 54, 56 may be cylindrical or have another appropriate shape. The base 22 may also include a tapered recessed opening 58 at the distal end 50 of the base 22, and the tip 14 may include a chamfered proximal end 51 sized to mate with the base 22. In such a configuration, the outer surfaces 60, 36 of the distal end 50 of the base 22 and the proximal end 16 of the tip 14 may be sized about the same to create a smooth joint between the base 22 and the tip 14. When the base 22 is pressed against the tip 14, the base 22 compresses the tip 14 by compressing the blade slots 24, reducing the size of the blade slots 24 so that portions of the tip 14 are compressed against the blades 18, which additionally supports the blades 18. The outer surface 60 of the base 22 may provide a transition between the outer surface 36 of the tip 14 and an arrow 12. In one embodiment, as shown in FIGS. 1-3, the outer surface 60 of the base 22 may be conical with the smaller end positioned at the distal end 50 of the base 22. The aft section 56 of the base 22 may include a recessed portion 64.

Figure 6:
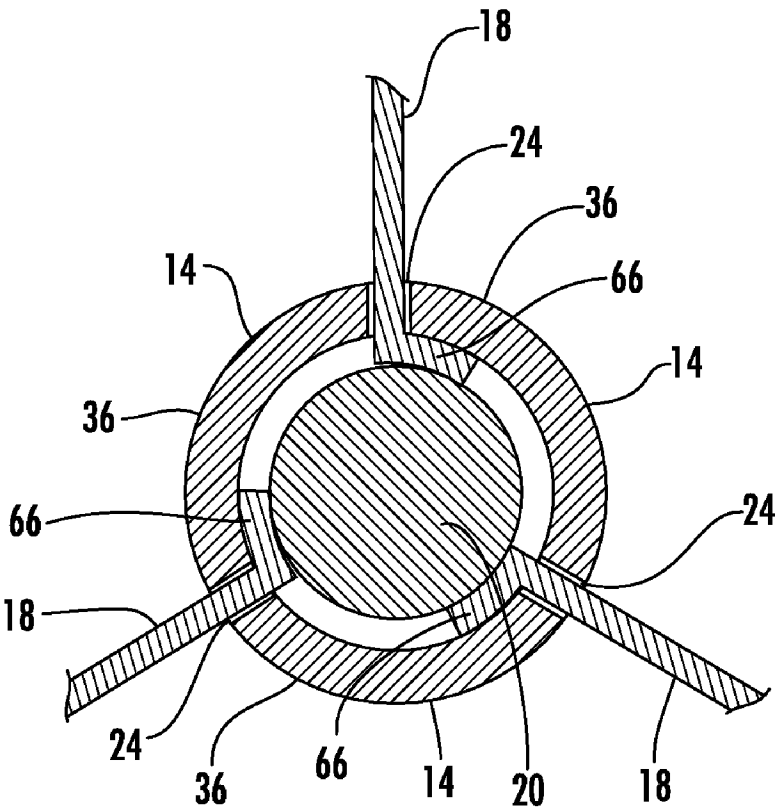
FIG. 6 is a cross-sectional view of the broadhead taken at section line 6-6 in FIG. 2.

The broadhead 10 may include one or more blades 18, and in at least one embodiment, may include a plurality of blades 18. The blades 18 may extend outwardly through the blade slots 24 in the tip 14. As shown in FIGS. 3 and 6, the blades 18 may include a securing flange 66 that extends from a radially inner portion of the blades 18. The securing flange 66 may be engaged by the elongated engaging bar 20 to secure the blades 18 within the tip 14. As shown in FIG. 2, the cutting arris 44 of the blade 18 may be positioned at an acute angle relative to the longitudinal axis 68 such that a distal end 70 of the cutting arris 44 comes into close proximity to the outer surface 36 of the tip 14 and a proximal end 72 of the cutting arris 44 is positioned radially outward from the outer surface 36. The blades 18 may also include a cutout portion 82 for reducing windage on the blade 18, thereby reducing the possibility of the blade 18 acting as an airfoil during arrow flight. The configuration of the cutout portion 82 may have any appropriate configuration that does not unsatisfactorily affect the structural integrity of the blade 18.

The securing flange 66 may be configured as shown in the numerous embodiments disclosed in U.S. Pat. No. 5,482,294, which is incorporated by reference herein. As shown in FIG. 6, the securing flange 66 may extend generally orthogonal from the blade 18. In such a position, the elongated engaging bar 20 prevents the blades 18 from being removed from the tip 14 because the securing flange 66 cannot be removed through the blade slots 24. In one embodiment, as shown in FIG. 3, the securing flange 66 of the blade 18 resides in a securing flange region 74 of the blade slot 24 and portions of the blade 18 without the securing flange 66 extending into the base blade slots 52 and into the distal blade slot region 76 on the tip 14.

Figure 4:
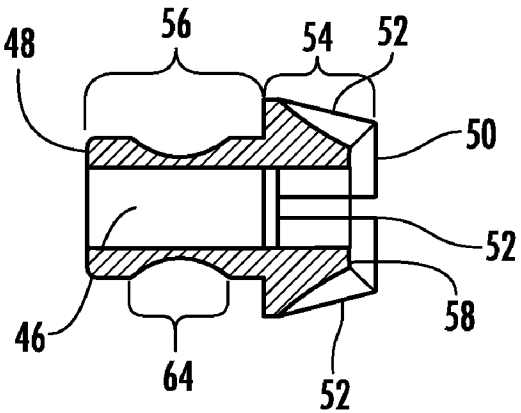
FIG. 4 is a cross-sectional view of the base of the broadhead taken at section line 4-4 in FIG. 3.

The elongated engaging bar 20, as shown in FIG. 3, may include a threaded proximal end 78 and an opposite threaded distal end 80. A distal portion of the elongated engaging bar 20 may be sized to extend through the central base chamber 46 of the base 22, as shown in FIG. 4, and into the central tip chamber 32, as shown in FIG. 5. The threaded distal end 80 may threadably engage the threaded distal tip chamber 34. As shown in FIG. 3, the elongated engaging bar 20 may include a bar stop 90 that extends radially a distance sufficient to contact the proximal end 48 of the base 22 when the threaded distal end 80 is threaded into the threaded distal tip chamber 34. The bar stop 90 may be a protrusion, a collar, or other appropriate device. The elongated engaging bar 20 may be generally cylindrical or have any other appropriate cross-sectional shape. In at least one embodiment, the threaded proximal and distal ends 78, 80 may include threads with pitches that differ from each other such that the broadhead 10 may be tunable, as discussed in detail below. In one embodiment, the threaded distal end 80 may include threads having 48 threads per inch with a size 4, and the threaded proximal end 78 may include threads having 32 threads per inch with a size 8. The elongated engaging bar 20 may also include a keyway 96, such as, but not limited to, a recessed hex keyway, at the proximal end 78 enabling the elongated engaging bar 20 to be tightened or loosened.

Figure 7:
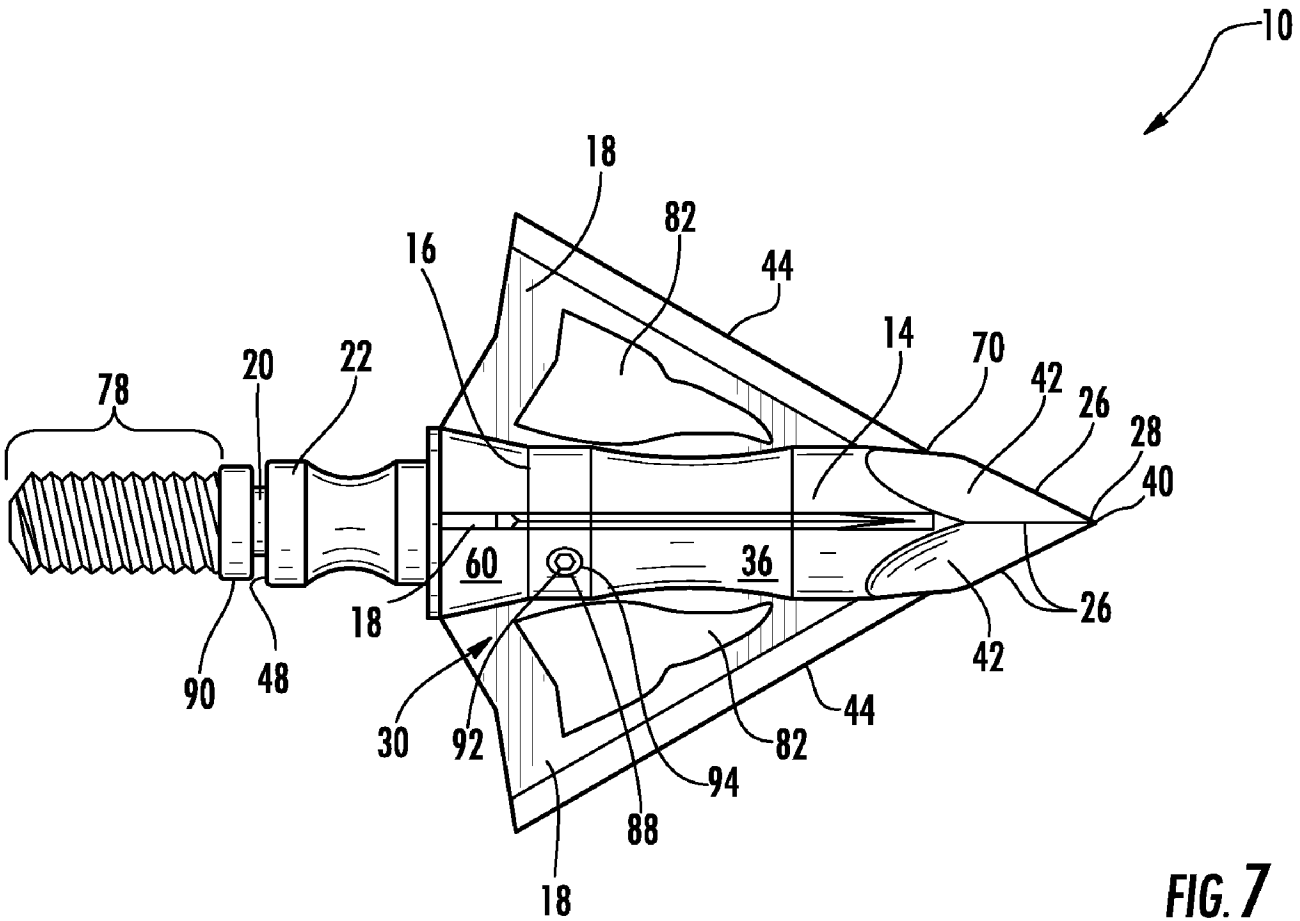
FIG. 7 is an alternative embodiment of the broadhead.
Figure 8:
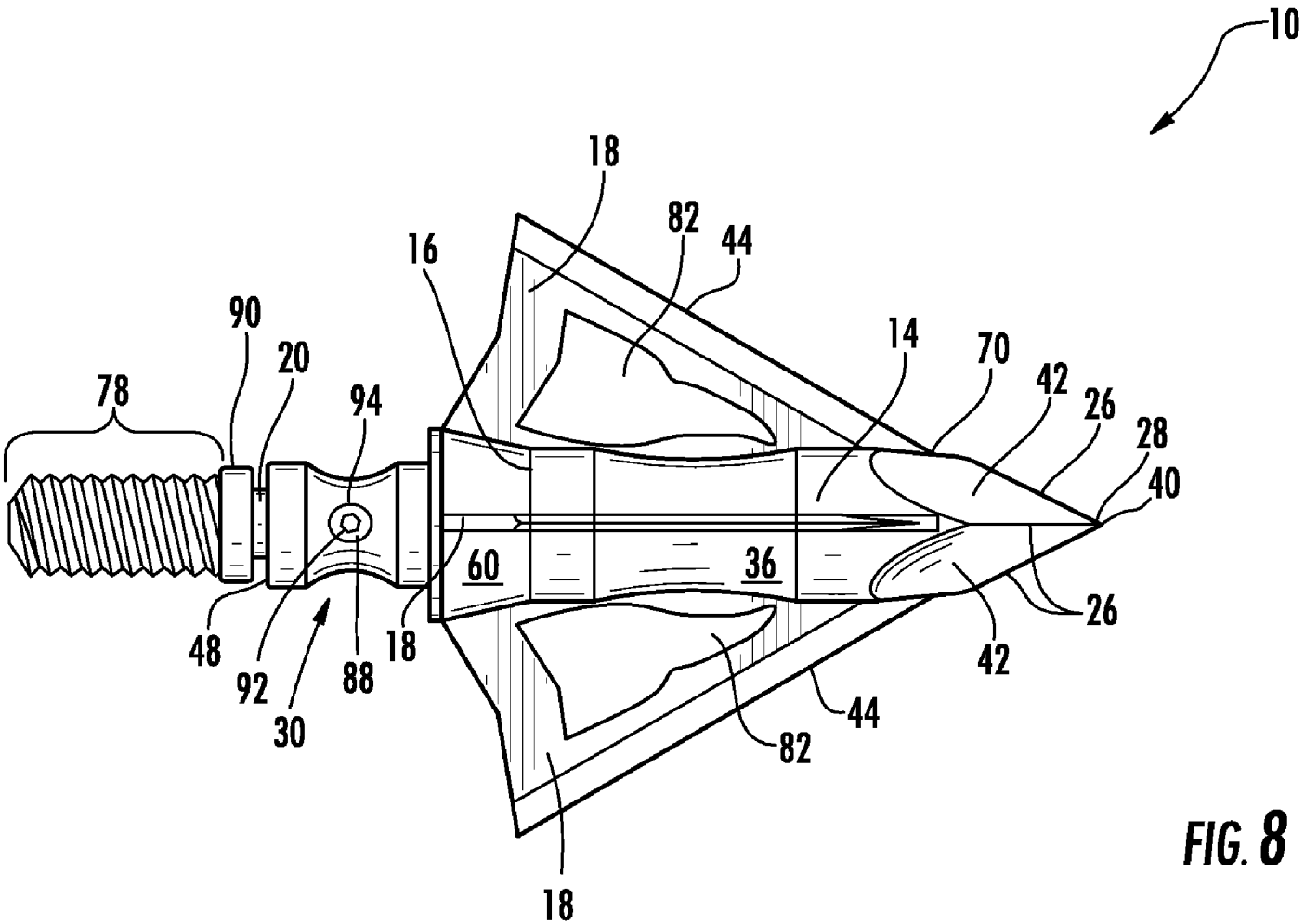
FIG. 8 is another alternative embodiment of the broadhead.

The broadhead 10 may be secured to an arrow shaft 12 such that the broadhead 10 may be adjustable about a longitudinal axis 68 relative to the arrow shaft 12. In particular, the broadhead 10 may be rotatable about the longitudinal axis 68 such that blades 18 extending outwardly may be moved into different positions relative to the arrow shaft 12 to tune arrow flight. The broadhead 10 may include a tunable broadhead system 30, as shown in FIGS. 3, 7 and 8, enabling orientation of the blades 18 of the broadhead 10 to be changed relative to an arrow 12 into which the threaded proximal end 78 of the elongated engaging bar 20 may be inserted. In one embodiment, as shown in FIG. 3, the tunable broadhead system 30 may comprise a threadlocker material 86 applied to the threaded distal end 80 of the elongated engaging bar 20 increasing the friction between the threads of the distal tip chamber 34 and the threaded distal end 80 of the elongated engaging bar 20 such that a force required to rotate the elongated engaging bar 20 is greater than a force necessary to rotate the threaded proximal end 78 of the elongated engaging bar 20 into an insert of an arrow 12. As such, the broadhead may be attached to an insert of an arrow 12 without the elongated engaging bar 20 rotating first. The threadlocker material 86 may be, but is not limited to, NYLOK BLUE PATCH, offered for sale by Macomb, Michigan or other materials effective to increase the friction between the two components without creating a permanent attachment.

In other embodiments, as shown in FIGS. 7 and 8, the tunable broadhead system 30 may be formed from a releasable locking device 88 configured to releasably affix the elongated engaging bar 20 relative to the tip 14 to prevent the elongated engaging bar 20 from being rotated relative to the tip 14. The releasable locking device 88 may be formed from a threaded set screw 92 threadably attached to a threaded orifice 94 in the tip 14, as shown in FIG. 7. The set screw may be tightened against the elongated engaging bar 20 to prevent the bar 20 from rotating. In another embodiment, the releasable locking device 88 may be formed from a threaded set screw 92 threadably attached to a threaded orifice 94 in the base 22, as shown in FIG. 8. In either embodiment, the elongated engaging bar 20 may be loosened a desired amount to change the distance between the proximal end 78 of the elongated engaging bar 20 and the head section 54 of the base 22. In embodiments where the bar stop 90 of the elongated engaging bar 20 does not bear upon the proximal end 48 of the base 22, the base 22 is forced axially against the tip 14 by an insert of an arrow 12 when the broadhead 10 is attached to the arrow 12.

The threads on the threaded distal end 80 of the elongated engaging bar 20 may be sized with a different pitch than the threads on the threaded proximal end 78. Such a configuration enables the orientation of the blades 18 to be changed. Otherwise, if the thread pitch of the threaded distal end 80 were equivalent to the thread pitch of the threaded proximal end 78, then orientation of the blades 18 would not change even though the elongated engaging bar 20 had been backed out. In particular, the threaded distal end 80 may be rotated to move the threaded proximal end 78. Because the threads of the threaded distal end 80 are pitched differently than the threaded proximal end 78, the tip 14 and base 22 may rotate a different amount before contacting the insert of the arrow 12, thereby creating a different alignment for the blades 18 relative to the arrow 12.

The broadhead 10 may consist of the separate components shown in FIG. 3 and assembled together. The blades 18 may be inserted into the blade slots 24 axially by first aligning the securing flange 66 generally with the longitudinal axis 68 and within the central tip chamber 32. Distal aspects of the blade 18 may be inserted into the distal blade slot region 76 that is radially outward from the threaded distal tip chamber 34. Once all of the blades 18 have been inserted into the blade slots 24, the elongated engaging bar 20 may be inserted through the base 22 and into the central tip chamber 32. The elongated engaging bar 20 may be inserted such that the threaded distal end 80 is threaded into the threaded distal tip chamber 34. The base blade slots 52 may be aligned with the blades 18. The bar stop 90 of the elongated engaging bar 20 may be tightened against the aft section 56 of the base 22. The broadhead 10 may be attached to an insert of an arrow 12. The orientation of the blades 18 may be checked in relation to the nock on the arrow or other references. If the orientation of the blades 18 is desired to be changed, the broadhead 10 may be removed from the arrow 12. The tunable broadhead system 30 enables the blades 18 to be oriented differently by enabling the usable length of the elongated engaging bar 20 to be adjusted. In embodiments in which the threadlocker material is used, the elongated engaging bar 20 simply needs to be rotated to increase the length of the elongated engaging bar 20 extending from the tip 14. In embodiments in which a releasable locking device 88 is used, the releasable locking device 88 is released, the elongated engaging bar 20 moved and the releasable locking device 88 is engaged. The broadhead 10 may then be reattached to the arrow 12 where the blades 18 will have a different orientation. This process may be repeated if necessary.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A broadhead, comprising:

a tip configured to facilitate penetration of the blade into an object with a pointed distal end and an opposite, open proximal end;

wherein the tip includes a central tip chamber extending distally into the tip from the proximal end and at least one blade slot between an outer surface of the tip and the central tip chamber and extending from the proximal end of the tip toward the distal end;

a base positioned proximally of the tip and having a central base chamber;

at least one blade positioned in one of the at least one blade slot and extending outwardly from the tip, wherein a securing flange extending from the at least one blade extends into the central chamber; and an elongated engaging bar having a threaded proximal end and a threaded distal end and extending through the central base chamber of the base and into the central tip chamber, wherein the threaded distal end threadably engages the threaded distal tip chamber.

2. The broadhead of claim 1, wherein the base includes at least one base blade slot corresponding to the at least one blade slot in the tip that receives the at least one blade and prevents the at least one blade from moving axially rearward.

3. The broadhead of claim 2, wherein the at least one base blade slot is contained within a head section of the base, whereby the head section extends radially outwardly further than an aft section of the base.

4. The broadhead of claim 2, wherein the base further comprises a tapered recessed opening at the distal end of the base, and the tip includes a chamfered proximal end sized to mate with the tapered recessed opening of the base.

5. The broadhead of claim 2, wherein the securing flange of the at least one blade resides in a securing flange region of the at least one blade slot and portions of the at least one blade without the securing flange extend into the at least one base blade slot and into a distal blade slot region on the tip.

6. The broadhead of claim 1, wherein the pointed tip is formed from a trocar having a plurality of cutting arrises, wherein the cutting arrises are aligned with the at least one blade slot.

7. The broadhead of claim 1, further comprising a tunable broadhead system enabling orientation of the at least one blade of the broadhead to be changed relative to an arrow into which the threaded proximal end of the elongated engaging bar is configured to be inserted.

8. The broadhead of claim 7, wherein the tunable broadhead system comprises a threadlocker material applied to the threaded distal end of the elongated engaging bar increasing the friction between threads in the tip and the threaded distal end of the elongated engaging bar such that a force required to rotate the elongated engaging bar is greater than a force necessary to rotate the threaded proximal end of the elongated engaging bar into an insert of an arrow.

9. The broadhead of claim 7, wherein the tunable broadhead system comprises a releasable locking device configured to releasably affix the elongated engaging bar relative to the tip to prevent the elongated engaging bar from being rotated relative to the tip.

10. The broadhead of claim 9, wherein the releasable locking device comprises a threaded set screw threadably attached to a threaded orifice in the tip.

11. The broadhead of claim 9, wherein the releasable locking device comprises a threaded set screw threadably attached to a threaded orifice in the base.

12. The broadhead of claim 7, wherein the tunable broadhead system comprises a releasable locking device configured to releasably affix the elongated engaging bar relative to the base to prevent the elongated engaging bar from being rotated relative to the base.

13. The broadhead of claim 1, wherein the elongated engaging bar includes a bar stop extending radially a distance sufficient to contact a proximal end the base.

14. A broadhead, comprising:

a tip configured to facilitate penetration of the broadhead into an object with a pointed distal end and an opposite, open proximal end;

wherein the tip includes a central tip chamber extending distally into the tip from the proximal end, a threaded distal tip chamber extending distally from a distal end of the central chamber, and a plurality of blade slots between an outer surface of the tip and the central chamber and extending from the proximal end of the tip toward the distal end;

a base positioned proximally of the tip and having a central base chamber;

a plurality of blades positioned in the blade slots and extending outwardly from the tip, wherein securing flanges extending from the blades extend into the central chamber;

an elongated engaging bar having a threaded proximal end and a threaded distal end and extending through the central base chamber of the base and into the central tip chamber, wherein the threaded distal end threadably engages the threaded distal tip chamber;

wherein the elongated engaging bar includes a bar stop extending radially a distance sufficient to contact a proximal end the base;

wherein the base includes base blade slots corresponding to the plurality of blade slots in the tip that receive the blades and prevent the blades from moving axially rearward; and wherein the pointed tip is formed from a trocar having a plurality of cutting arrises, wherein the cutting arrises are aligned with the blade slots.

15. The broadhead of claim 14, wherein the base blade slots are contained within a head section of the base, whereby the head section extends radially outwardly further than an aft section of the base.

16. The broadhead of claim 14, wherein the base further comprises a tapered recessed opening at the distal end of the base, and the tip includes a chamfered proximal end sized to mate with the tapered recessed opening of the base.

17. The broadhead of claim 14, wherein the securing flanges of the blades reside in securing flange regions of the blade slots and portions of the blades without the securing flanges extend into the base blade slots and into distal blade slot regions on the tip.

18. The broadhead of claim 14, further comprising a tunable broadhead system comprises a threadlocker material applied to the threaded distal end of the elongated engaging bar increasing the friction between threads of the distal tip chamber and the threaded distal end of the elongated engaging bar such that a force required to rotate the elongated engaging bar is greater than a force necessary to rotate the threaded proximal end of the elongated engaging bar into an insert of an arrow.

19. The broadhead of claim 14, further comprising a tunable broadhead system comprises a releasable locking device configured to releasably affix the elongated engaging bar relative to the tip to prevent the elongated engaging bar from being rotated relative to the tip, the releasable locking device being a threaded set screw threadably attached to a threaded orifice in the tip.

20. A broadhead, comprising:

a tip configured to facilitate penetration of the broadhead into an object with a pointed distal end and an opposite, open proximal end;

wherein the tip includes a central tip chamber extending distally into the tip from the proximal end, a threaded distal tip chamber extending distally from a distal end of the central chamber, and a plurality of blade slots between an outer surface of the tip and the central chamber and extending from the proximal end of the tip toward the distal end;

a base positioned proximally of the tip and having a central base chamber;

a plurality of blades positioned in the blade slots and extending outwardly from the tip, wherein securing flanges extending from the blades extend into the central chamber;

an elongated engaging bar having a threaded proximal end and a threaded distal end and extending through the central base chamber of the base and into the central tip chamber, wherein the threaded distal end threadably engages the threaded distal tip chamber;

wherein the elongated bar includes a bar stop extending radially a distance sufficient to contact a proximal end the base;

wherein the base includes base blade slots corresponding to the plurality of blade slots in the tip that receive the blades and prevent the blades from moving axially rearward;

wherein the pointed tip is formed from a trocar having a plurality of cutting arrises, wherein the cutting arrises are aligned with the blade slots; and a tunable broadhead system enabling orientation of the blades of the broadhead to be changed relative to an arrow into which the threaded proximal end of the elongated engaging bar may be inserted.

* * * * *